US009599963B2

(12) United States Patent
Legeret et al.

(10) Patent No.: US 9,599,963 B2
(45) Date of Patent: Mar. 21, 2017

(54) MECHANISM FOR THE MAGNETIC ACTUATION OF TIMEPIECE STRIKING MECHANISMS

(71) Applicant: Montres Breguet S.A., L'Abbaye (CH)

(72) Inventors: Benoit Legeret, Le Sentier (CH); Davide Sarchi, Renens (CH); Gianni Di Domenico, Neuchatel (CH); Jerome Favre, Neuchatel (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/089,613

(22) Filed: Apr. 4, 2016

(65) Prior Publication Data

US 2016/0299472 A1 Oct. 13, 2016

(30) Foreign Application Priority Data

Apr. 9, 2015 (EP) ..... 15162913

(51) Int. Cl.
*G04B 21/06* (2006.01)
*G04B 23/02* (2006.01)
(Continued)

(52) U.S. Cl.
CPC ..... *G04B 21/06* (2013.01); *G04B 23/023* (2013.01); *G04B 23/026* (2013.01); *G10D 13/00* (2013.01); *G10F 1/10* (2013.01); *G10K 1/067* (2013.01)

(58) Field of Classification Search
CPC ..... G04B 21/02; G04B 21/06; G04B 21/14; G04B 23/00; G04B 23/02; G04B 23/021;
(Continued)

(56) References Cited

U.S. PATENT DOCUMENTS 641,475 A * 1/1900 Torres ..... G04B 21/14 368/267
3,121,194 A * 2/1964 Stehlik ..... G10K 1/062 335/230

(Continued)

FOREIGN PATENT DOCUMENTS

JP 60-122999 U 8/1985

OTHER PUBLICATIONS

European Search Report issued Feb. 11, 2016 in European Application 15162913, filed Apr. 9, 2015 ( with English Translation).

*Primary Examiner* — Vit W Miska
(74) *Attorney, Agent, or Firm* — Oblon, McClelland, Maier & Neustadt, L.L.P.

(57) ABSTRACT

A watch including a timepiece striking mechanism, including a drive mechanism for driving and controlling the striking mechanism to operate at least one rigid hammer, movable between a first winding position and a second striking position, the hammer being arranged to strike a gong in the second striking position, this hammer including at least one magnetized portion arranged to cooperate with at least one actuator arranged to be driven in motion by the drive mechanism, the actuator including an alternating series of first areas and second areas with different magnetic field characteristics from each other, to whose influence the magnetized portion is successively subjected on order to trigger, as the case may be, the winding of the hammer or the striking of the hammer on the gong.

19 Claims, 3 Drawing Sheets

(51) Int. Cl.

| | |
|---|---|
| ***G10F 1/10*** | (2006.01) |
| ***G10K 1/067*** | (2006.01) |
| ***G10D 13/00*** | (2006.01) |

(58) Field of Classification Search
CPC ..... G04B 23/023; G04B 23/026; G10F 1/10; G10K 1/067; G10D 13/00; G04C 21/06
See application file for complete search history.

(56) References Cited

U.S. PATENT DOCUMENTS

| | | | | |
|---|---|---|---|---|
| 4,255,744 | A | 3/1981 | Link | |
| 2012/0147715 | A1* | 6/2012 | Karapatis ..... | G04B 21/06 368/267 |
| 2012/0155227 | A1* | 6/2012 | Karapatis ..... | G04B 21/06 368/243 |

* cited by examiner

Fig. 1
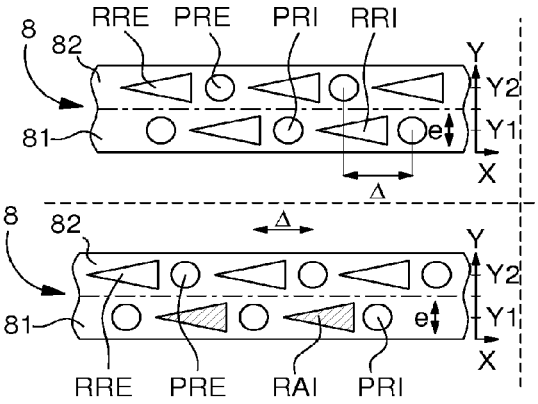
Fig. 2
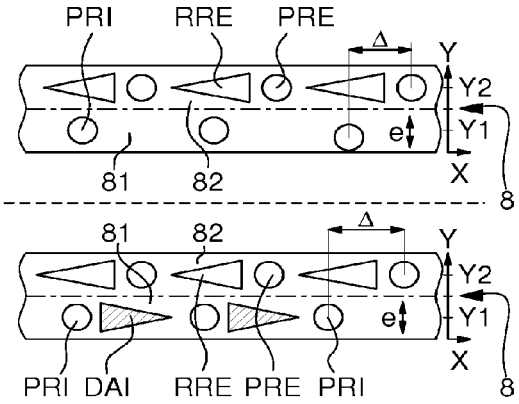
Fig. 3
Fig. 4
Fig. 5
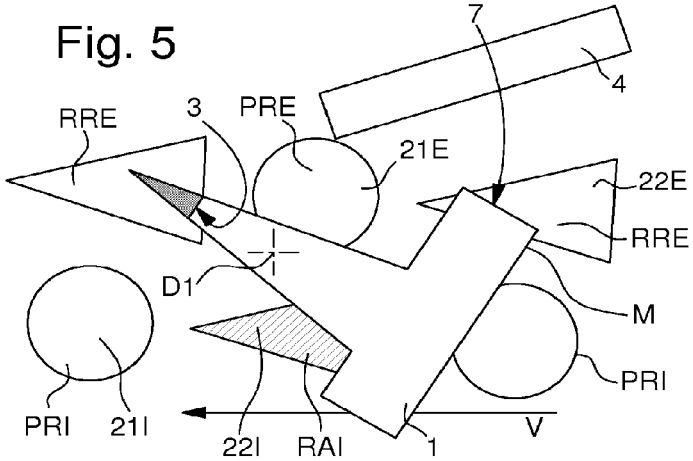
Fig. 6
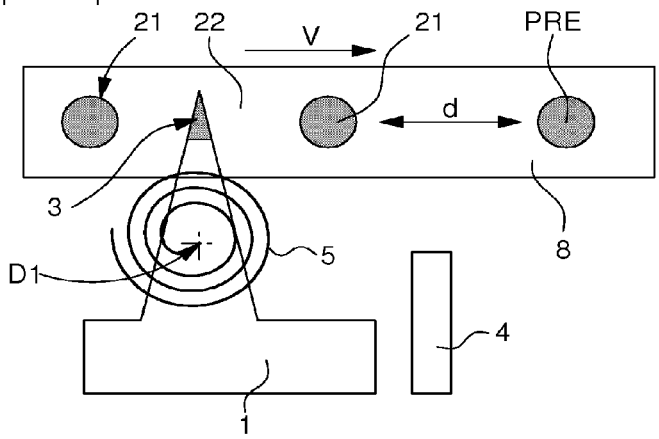

MECHANISM FOR THE MAGNETIC ACTUATION OF TIMEPIECE STRIKING MECHANISMS

This application claims priority from European Patent application 15162913.6 of Apr. 9, 2015, the entire disclosure of which is hereby incorporated herein by reference.

FIELD OF THE INVENTION

The invention concerns a watch comprising a timepiece striking mechanism, including a drive mechanism for driving and controlling the striking mechanism to operate at least one rigid hammer, movable between a first winding position and a second striking position, said hammer being arranged to strike a gong in said second striking position.

The invention concerns the field of striking watches.

BACKGROUND OF THE INVENTION

A conventional striking mechanism for timepieces, particularly watches, using at least one rigid hammer, wound by a spring, and released by a control means to strike a given gong, generally has chronic disadvantages: part of the power released by the hammer spring is stored in the shock absorber and is not transmitted to the gong. Further, a second shock is often observed during the return travel from the gong, owing to the long time taken by the hammer to return to position. Distortion of the sound is unacceptable, especially in what is often an extremely expensive timepiece.

JP Patent S60122999U discloses a bell with a magnetized clapper, arranged to strike a bell, moved into certain positions by a magnetic field. U.S. Pat. No. 4,255,744A in the name of LINK, discloses a bell wherein a hammer cooperates with a gong in a circular arc, under the action of a closed relay circuit armed or disarmed by a permanent magnet driven in rotation by a control motor.

SUMMARY OF THE INVENTION

The invention proposes to improve the operation of hammers in a striking watch, by optimising the strike of the hammers on the gongs, and preventing a second shock of a hammer on a gong.

To this end, the invention concerns a watch comprising a striking mechanism according to claim 1.

BRIEF DESCRIPTION OF THE DRAWINGS

Other features and advantages of the invention will appear upon reading the following detailed description, with reference to the annexed drawings, in which:

FIG. 1 shows a schematic plan view of an actuator with, in a linear representation, an inner track and an outer track, which are parallel to each other and each include alternating ramps of increasing magnetic potential, with increasing magnetization, represented by triangles widening in the direction of increased magnetization, and potential peaks, represented by circles, these ramps and peaks being staggered on the two inner and outer tracks; the ramps and peaks always behave in the same manner, in particular in repulsion relative to a magnetized object of a given polarity moving above the tracks;

FIG. 2 shows, in a similar manner to FIG. 1, an outer track again including an alternating arrangement of increasing ramps and potential peaks, and an inner track comprising only potential peaks.

FIG. 3 shows, in a similar manner to FIG. 1, an outer track which again includes an alternating arrangement of increasing ramps and potential peaks, and an inner track including, in an alternating arrangement with potential peaks, increasing potential ramps of opposite polarity to the polarity of the peaks of the inner track and the ramps and peaks of the outer track and thus cooperating in attraction with a magnetized object of a given polarity moving above the tracks; in all the Figures, the hatched areas indicate an opposite magnetic polarity to that of the magnetized object concerned, notably a magnetized portion of a strike hammer.

FIG. 4 shows, in a similar manner to FIG. 1, an outer track which again includes an alternating arrangement of increasing ramps and potential peaks, and an inner track including, in an alternating arrangement with potential peaks, decreasing potential ramps of opposite polarity to the polarity of the peaks of the inner track and the ramps and peaks of the outer track and thus cooperating in attraction with a magnetized object of a given polarity moving above the tracks.

FIG. 5 shows a schematic plan view of an application of the FIG. 3 configuration to the operation of a magnetized movable element located in a parallel plane to that of the inner and outer tracks, this movable element being formed of a hammer comprising a magnetized portion shown in black at the end of an arm shown in dots, this hammer comprising a strike body with a striker arranged to strike a gong shown beyond the outer track.

FIG. 6 shows a schematic plan view of a strike mechanism comprising, on a track, a series of round magnets and a hammer, one end of which is magnetized, and which includes elastic return means, in the form of a spiral spring, returning it to a striking position, before a gong is struck.

DETAILED DESCRIPTION OF PREFERRED EMBODIMENTS

The invention proposes to apply to watches that include striking mechanisms the concept disclosed in EP Patent 13199427 in the name of THE SWATCH GROUP RESEARCH & DEVELOPMENT Ltd for a magnetic escapement mechanism, wherein a movable magnetized stop member, notably a pallet lever, cooperates in a contactless manner and alternately with magnetized tracks, with increasing magnetic field gradient ramps to a tipping point of said stop member.

The invention is disclosed here in a single magnetic variant. It is also applicable to the utilisation of electrostatic fields instead of magnetic fields, or in addition to such magnetic fields, notably through the use of electrets.

The invention is described in in two non-limiting forms:

- the first using two degrees of freedom, with a pivoting movable element cooperating with concentric or parallel tracks;
- the second using a single degree of freedom, with a movable element cooperating with a single track.

FIGS. 1 to 4 show various configurations using two neighbouring tracks, parallel to each other, and locally exhibiting different magnetic field distributions, with respect to a movable element located substantially at the interface of the tracks.

Figure 7:
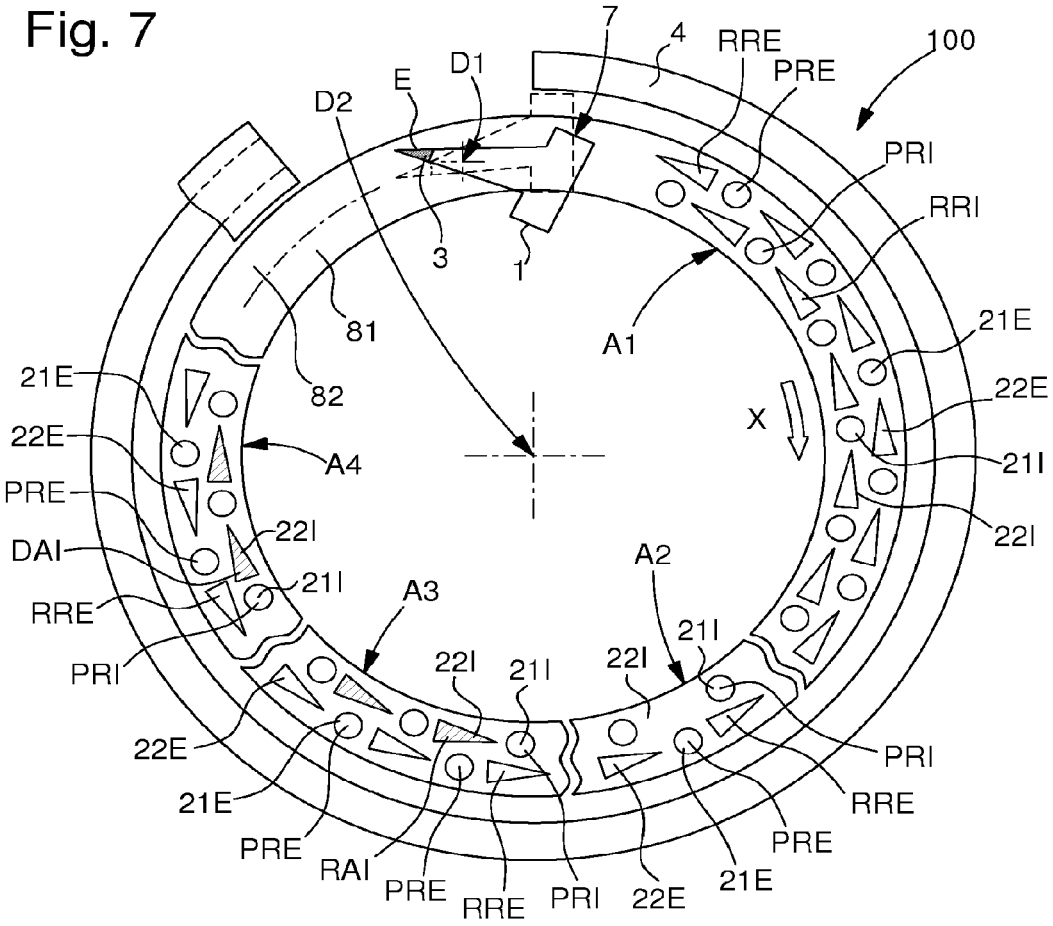
FIG. 7 shows a schematic plan view of an application of the configurations of FIGS. 1 to 4, with annular track segments in the various configurations, to the control of a hammer as in FIG. 5, for striking an annular gong.

These configurations are provided for strike hammer drive mechanisms for striking a gong, as illustrated in FIGS. 5 and 7.

The following different criteria are to be taken into account for these mechanisms:

- the amount of energy imparted to the gong at the strike;
- the speed with which the hammer returns to position after a strike, to avoid a second impact with the gong;
- the possibility of adjusting the strike speed, to compensate for torque variations.

FIGS. 1 to 4 are diagrams of tracks, comprising elements magnetized in different ways, which in each case form a particular magnetic field topography, in which a movable element magnetized with a particular polarity is manoeuvred, here a strike hammer, or a control lever for a strike hammer.

The magnetic potential topography defines the path that the magnetized movable element can travel, driven in a relative motion with respect to the tracks. By convention, although the pivot axis of the hammer is in theory fixed with respect to the watch plate, while the strike control tracks are preferably integral with a control wheel, it is considered here that the magnetized movable element moves above the tracks in a relative motion of axis X in the positive direction indicated by the arrow in the Figures.

By convention, it is considered here that:

for magnets in repulsion:

increasing magnetization implies an increasing potential;

decreasing magnetization implies a decreasing potential;

for magnets in attraction:

increasing magnetization implies a decreasing potential;

decreasing magnetization implies an increasing potential.

In these variants, the degree of freedom at X is used to establish a model for the temporal part of the strike, i.e. the time interval between the blows, whereas the degree of freedom in transverse direction Y corresponds to the displacement of the hammer between a striking position referenced y1, and a winding position referenced y2.

According to the invention, the functions are different in striking position y1 and winding position y2, and it is possible to consider asymmetrical configurations between y1 and y2.

Provided that the magnetization values on the inner and outer tracks are the same, only the FIG. 1 configuration obeys a symmetrical track change function: a magnetized movable element facing a repulsive outer ramp RRE of the outer track, on reaching a repulsive outer pole PRE of the same outer track, is thus switched onto the inner track, at the bottom of a repulsive inner ramp RRI, which it climbs until it reaches a repulsive inner pole PRI, and then switches onto the outer track, and so on.

The three variants of FIGS. 2 to 4 conversely show asymmetrical configurations.

The FIG. 2 variant consists of removing the field ramps from the inner track for the hammer striking position y1. This configuration has a dual advantage:

- on the one hand, the energy released at the change from winding position y2 to striking position y1 can be slightly increased;
- on the other hand, the resistance force, during the motion at X, is reduced in striking position y1.

Consequently, without regulation, the movable element moves more quickly when the hammer is in the striking position, and returns more quickly to the winding position, which results in the reduced risk of a second strike.

Further the distance Δ, on axis X, between a repulsive inner pole PRI and a repulsive outer pole PRE, may be dimensioned to obtain a fast return.

The dimensions must be adapted to ensure that, in this gap, the movable element acquires sufficient power from the propelling force.

An advantageous variant consists in introducing a governor, dimensioned to be effective essentially in the typical torque range experienced in winding position y2, and which can therefore acceptably be less effective in the typical torque range experienced in striking position y1. Ideally there are two flat regions, with two speeds corresponding to the two torque ranges.

The FIG. 3 variant proposes to replace the increasing gradients on the inner track corresponding to striking position y1, with decreasing gradients via areas of increasing attraction, during a positive motion at X. This variant accentuates the advantages of the FIG. 2 variant, namely the strike power and acceleration in striking position y1 for return to the winding position, but also accentuates the disadvantages. In particular, the change from striking position y1 to winding position y2 may be made more difficult, since the wheel has to ascend the potential. However, it is possible to dimension the magnetic areas so that the speed gathered through magnetic attraction and the propellant force are sufficient to overcome the potential difference between striking position y1 and winding position y2. It is noted that on this inner track, it is equivalent to have repulsive descending ramps or attractive ascending ramps RAI as illustrated. However, the energy imparted to the gong may be lower if repulsive descending ramps are used.

The FIG. 4 variant proposes to replace the magnets in repulsion with magnets in attraction, as regards the rising slopes of striking position y1 of the inner track. Here, there are attractive inner descents DAI. This system has the advantage of allowing more energy to be imparted to the gong during the strike. In this version, the phenomenon of acceleration of the movable element when the hammer is in the striking position is lost. It is possible, however, to ensure that the potential slopes, and thus the magnetic braking torque, are in the same in both striking position y1 and winding position y2. This makes it possible to dispense with regulation, unless it is desired to compensate for variations in the peak areas, which are preferably very short.

In all these variants, the distance e in transverse direction Y can be varied, for an automatic change from striking position y1 to winding position y2. To prevent any motion of the movable element in direction Y, the mechanism advantageously includes mechanical stops, and/or magnetic stops forming field barriers. If this distance is zero, the movable element must be moved away.

In short, the variants of FIGS. 1 to 4 are compromise solutions between a situation where the energy imparted is maximised, and a situation where the time spent in the striking position is minimised.

FIG. 5 shows a detail of the variant of FIG. 3, applied to the control of a hammer M, comprising a magnetized end E, pivoting about an axis D1, to strike a gong T.

FIG. 7 shows an example arrangement of annular tracks, according to the four variants of FIGS. 1 to 4, for controlling such a hammer.

The FIG. 6 variant combines mechanical and magnetic actuation, to ensure the supply of a sufficient amount of energy to the system for the manoeuvre. The mechanism is one-dimensional, and the single track includes only potential peaks. This track with magnets at a regular distance d passes in proximity to a hammer, one end of which is magnetized, generating a torque that rotates and winds the hammer. In rotating, the hammer winds a spring which tends to return it in the striking direction. After a certain displacement, the spring torque reaches the maximum magnetic torque and the hammer passes the tip of the potential peak. From that moment on, the hammer is accelerated by the spring and by magnetic repulsion. The maximum energy to be imparted to the gong is thus the sum of the potential energy of the spring and the potential magnetic energy of the peak. This total energy is higher than in the variants of FIGS. 1 to 4. By suitable dimensioning of distance D, it is possible to use the next potential rise to return the hammer quickly and avoid a second shock. In this configuration, it is entirely possible to regulate the speed v of the movable element, just as it is possible not to regulate the speed by accelerating the repositioning of the hammer when the magnetic torque is zero, or to partially regulate the speed by only dimensioning a regulation within the torque range above a given value.

Thus, more specifically, and as seen in the Figures, the invention concerns a timepiece striking mechanism 100, including a drive mechanism 10 for driving and controlling the striking mechanism to operate at least one hammer 1, movable between a first winding position and a second striking position. In this second striking position, hammer 1 is arranged to strike a gong 4.

More specifically, this timepiece striking mechanism 100 is a watch striking mechanism, with rigid hammers arranged to operate in any position of the watch in space.

According to the invention, hammer 1 includes at least one magnetized portion 3, which is arranged to cooperate with at least one actuator 8, capable of being driven in motion by drive mechanism 10.

This actuator 8 includes at least one track with an alternating series of at least first areas 21 and second areas 22 with different magnetic field characteristics from each other. The magnetized portion 3 is successively subjected to the influence of these first areas 21 and second areas 22, in order to trigger, as the case may be, the winding of hammer 1 or the strike of hammer 1 on gong 4.

According to the invention, in each track comprised in such an actuator 8, the first areas 21 each form a magnetic potential peak where the magnetic field has the greatest intensity in the track concerned, and each form a magnetic field barrier, of the same magnetic polarity as magnetized portion 3 of hammer 1, and tending to prevent magnetized portion 3 of hammer 1 crossing thereover.

Figure 8:
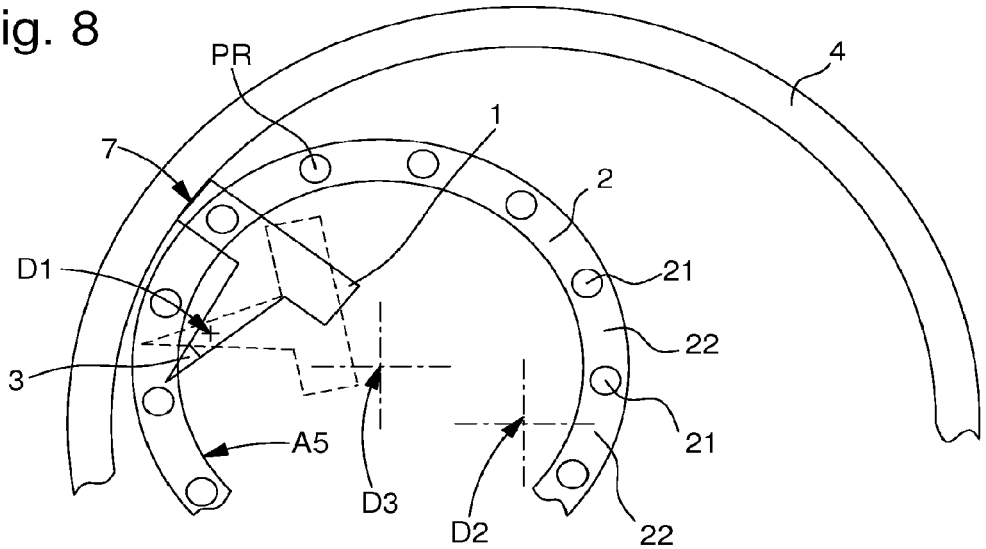
FIG. 8 shows a schematic plan view of an application of the FIG. 6 configuration, with a circular track, to the control of a hammer for striking an annular gong.

In the variant of FIGS. 6 and 8, actuator 8 includes at least one track with an alternating arrangement of such first areas 21 and second areas 22 which are not magnetized. The periodic interaction between first magnetic potential peak areas 21 and the magnetized portion 3 of hammer 1 tends to push the magnetized portion 3 off the track, notably seen in plan, and/or off actuator 8, notably seen in plan, and hammer 1 includes elastic return means 5 tending to return it to a position above the track and/or actuator 8.

The embodiments of FIGS. 1 to 4 and 7, actuator 8 includes at least a first track 81 including an alternating arrangement of first areas 21 and second areas 22, and a second track 82 adjacent to first track 81 and which also includes an alternating arrangement of first areas 21 and second areas 22. The magnetic field characteristics between first areas 21 and second areas 22 are different within each track 81, 82 concerned.

In the embodiments of FIGS. 1 to 4, 7 and 10, actuator 8 is annular, and a first track 81 is annular, concentric and adjacent to a second track 82, which is also annular.

More specifically, first areas 21 of first track 81 are adjacent to second areas 22 of second track 82, and second areas 22 of first track 81 are adjacent to first areas 21 of second track 82. This thus ensures a swinging motion of the hammer between its winding and striking positions, throughout the operation of the striking mechanism.

As seen in FIGS. 1 to 4 and 7, in at least one track comprised in actuator 8, second areas 22 each form a magnetic potential ramp where the magnetic field is of increasing or decreasing intensity, and they exchange energy with magnetized portion 3 of hammer 1 during the relative displacement of actuator 8 with respect to hammer 1.

In a first case, the potential ramp is an ascending ramp.

In a second case, as seen in FIG. 4, the potential ramp is a descending ramp.

In different variants, the potential ramp is of the same magnetic polarity as magnetized portion 3 of hammer 1.

In other variants, notably in FIGS. 3 to 5, the potential ramp is of the opposite magnetic polarity to that of magnetized portion 3 of hammer 1.

In a variant corresponding to FIGS. 1 and 7, actuator 8 is a first ring Al comprising an inner track 81 and an outer track 82, each comprising an alternating arrangement of second areas 22, each forming one increasing magnetic potential ramp, with increasing magnetization, and of first areas 24 forming potential peaks. The ramps and peaks are staggered on both inner track 81 and outer track 82 and always behave in repulsion with respect to magnetized portion 3 of hammer 1 moving above tracks 81 and 82.

In a variant corresponding to FIGS. 2 and 7, actuator 8 is a second ring A2 comprising an inner track 81 according to FIG. 2, and an outer track 82 comprising an alternating arrangement of second areas 22, each forming one increasing magnetic potential ramp, with increasing magnetization, and of first areas 21 forming potential peaks, the peaks being staggered on both inner track 81 and outer track 82. The ramps and peaks of the two tracks 81, 82 always behave in repulsion with respect to magnetized portion 3 of hammer 1 moving above tracks 81, 82.

In a variant corresponding to FIGS. 3 and 7, actuator 8 is a third ring A3 comprising an outer track 82, including an alternating arrangement of second areas 22, each forming one increasing magnetic potential ramp, with increasing magnetization, and of first areas 21 forming potential peaks, the ramps and peaks of outer track 82 always behaving in repulsion with respect to magnetized portion 3 of hammer 1 moving above tracks 81, 82. It also includes an inner track 81 comprising an alternating arrangement of second areas 22 according to FIG. 3, each forming one potential ramp of ramps of decreasing magnetic potential, with increasing magnetization, but of opposite polarity to that of magnetized portion 3 of hammer 1 moving above tracks 81 and 82, and of first areas 21 forming potential peaks. The peaks are staggered on both inner track 81 and outer track 82, and the peaks of the two tracks 81 and 82 always behave in repulsion with respect to magnetized portion 3 of hammer 1 moving above tracks 81 and 82.

In a variant corresponding to FIGS. 4 and 7, actuator 8 is a fourth ring A4 comprising an outer track 82, including an alternating arrangement of second areas 22, each forming one increasing magnetic potential ramp, with increasing magnetization, and of first areas 21 forming potential peaks, the ramps and peaks of outer track 82 always behaving in repulsion with respect to magnetized portion 3 of hammer 1 moving above tracks 81, 82, and an inner track 81 comprising an alternating arrangement of second areas 22 according to FIG. 4, each forming one potential ramp of ramps of increasing magnetic potential, with decreasing magnetization, but of opposite polarity to that of magnetized portion 3 of hammer 1 moving above tracks 81 and 82, and of first areas 21 forming potential peaks. The peaks are staggered on both inner track 81 and outer track 82, and the peaks of the two tracks 81, 82 always behave in repulsion with respect to magnetized portion 3 of hammer 1 moving above tracks 81 and 82.

In a particular embodiment of the various variants, hammer 1 includes elastic return means 5 tending to return the hammer so that it is above the track and/or actuator 8 towards its striking position.

Figure 10:
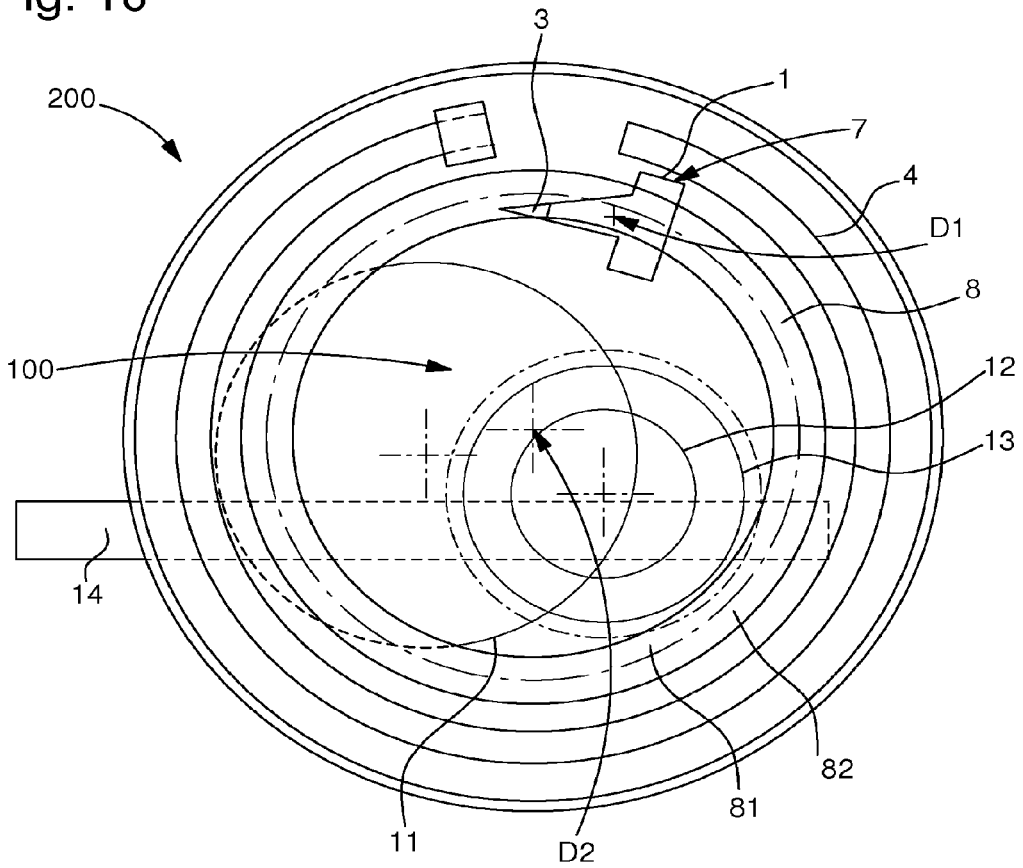
FIG. 10 shows a schematic front view of the watch of FIG. 9, with a first hammer intended for a first gong.
Figure 9:
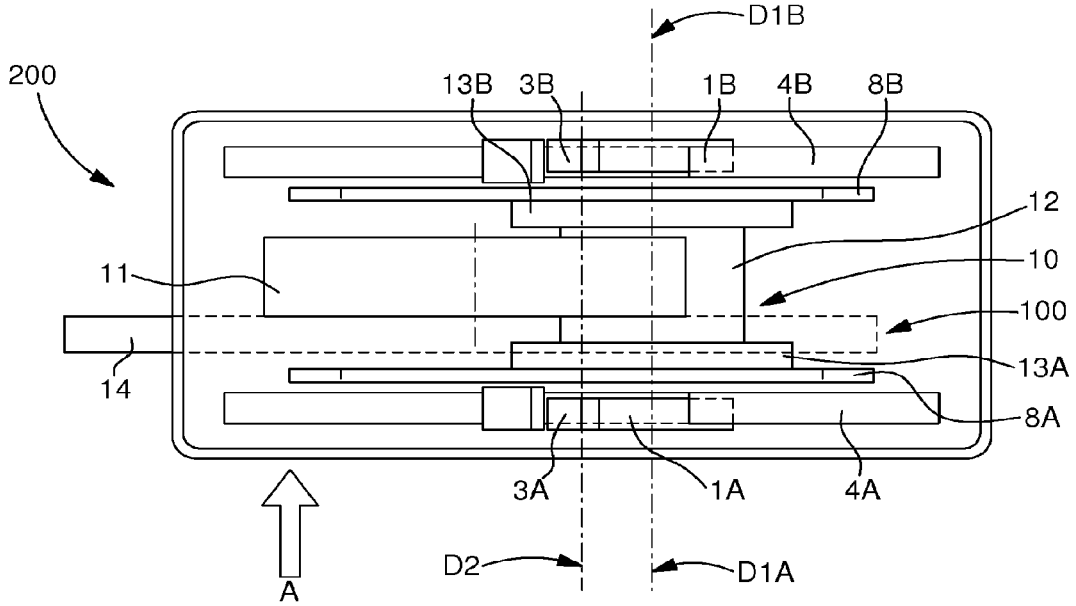
FIG. 9 shows a schematic top view, through a transparent case, of a watch according to the invention, with a drive mechanism comprising a striking barrel wound by a timepiece movement or by a push-piece, and means of determining the sound display to perform, arranged to control the transmission of energy to two drive wheel sets, each driving an annular magnetic actuator of the invention to control the winding and striking of a hammer intended for a specific gong, the two gongs being represented on the opposite faces of the watch, on either side of the control mechanism.

In a non-limiting variant illustrated in FIGS. 9 and 10, drive mechanism 10 includes at least one striking barrel 11 wound by a timepiece movement or by a bolt 14 or push-piece, and determination means 12 for determining the sound display to perform. These determination means 12 are arranged to control the transmission of energy from at least one barrel 11 to at least one drive wheel set 13 arranged to drive at least one actuator 8 for the required duration and at a substantially constant speed.

More specifically, determination means 12 are arranged to control a plurality of drive wheels 13A, 13B, each arranged to drive at least one actuator 8A, 8B, in order to strike a specific gong 4A, 4B.

As regards the shape of the ramps, in a non-limiting manner, the following may be used:

- linearly increasing (or of course decreasing) ramps, i.e. with a linear potential variation,
- ramps exhibiting a differential increase: a steep curve at the start, for accelerating the movable element very early on, and a gentler curve at the end, this magnetic potential profile being particularly effective for a rapid return from the striking position to the winding position.

Although the conventional construction of a striking mechanism, such as a minute repeater, involves a hammer with a fixed axis of rotation, a fixed gong and a movable actuator, it is also possible to envisage the reverse configuration, on the same principle of the invention, wherein the hammer and gong are movable above the actuator which is fixed.

Actuator 8 is thus immobile, when hammer 1 and gong 4 are driven in motion by drive mechanism 10.

This configuration where the gong is in motion makes it possible to modulate the ding-dong sound (tonality), since the distribution of the various partials (notes) contributing to the sound varies with the position of the gong inside the external parts of the watch. It also enables acoustic and aesthetic effects to be created with the relative position of at least two gongs (for example for the hours and minutes).

In a particular embodiment of this variant, the gong rotates.

The gong may then be driven or be a free wheel. In this last example, the free wheel gong may form an oscillating weight, or, conversely, an oscillating weight may be used as a gong.

In another particular embodiment of this variant, the gong has a linear motion.

In a variant, the percussion between the hammer and the gong occurs at different locations, which may be determined (for example connection nodes) or, conversely, random.

These variants are well suited to magnetic maintenance, which does not require any contact between the plate and the hammer, which could therefore move integrally with the gong.

For conventional maintenance, although it is of course complex to produce a design with movable gongs and hammers, two advantageous possibilities emerge:

- moving only the gongs, with several fixed hammers in defined positions;
- moving the hammer and gong integrally, and actuating the hammer by strip-springs or pins, like a vibration plate.

A significant advantage of these movable gong variants is that it is possible to modulate the tonality of the sound.

Other advantages ensue. In particular, it is possible to modulate tonality by moving the hammer and gong integrally inside a case having a highly inhomogeneous vibrational response. One example is that of a case fitted with a crystal and membrane, wherein the bond between the movement and the membrane is at 3 o'clock and at 9 o'clock, and the bond with the bezel-crystal is at 12 o'clock and at 6 o'clock: in that case the gong frequencies tuned to the bezel-crystal are activated and radiated more when the gong is at 12 o'clock and 6 o'clock, whereas the gong frequencies tuned to the membrane are activated and radiated more when the gong is at 3 o'clock and 9 o'clock. The emitted sound may thus be higher or lower depending on the position of the gong. Indeed, even if the partials of the gong, and therefore the notes, are still the same, their relative weight in the sound is changed.

The design of special external parts, including recesses, side membranes, resonators, acoustic radiating members, or suchlike, can also change the directivity of sound, in the manner of a stereophonic effect between two or more gongs.

Tonality modulation may be even greater if only the gong moves into several positions, in correspondence to different hammers (for example 3 or 4) positioned to strike the gong at different locations. The sound becomes deeper away from the point of attachment of the gong.

A particular case concerns the use of a straight rectangular gong, which can rotate on its axis to change its stiffness and thus the partials most activated on impact. A specific and very advantageous application of these solutions consists in varying the tonality of the sound between day and night.

Another very practical advantage consists in causing the gong to change from a rest position, for example a slightly stressed position, to one or more operating positions, with the gong free or in abutment with a different active length for each position, limiting the risk of plastic deformation and unwanted shocks, without hindering the freedom of the gong and thus the intensity and duration of the sound produced. In such case, since the active length is changed, the sound can be completely modified, by modifying the notes produced and not simply the tonality, during the change from one position to another.

A movable gong may also advantageously be used as a display component, notably made in the form of a straight or hand-shaped gong.

The invention also concerns a watch 200 including at least one such striking mechanism 100.

The invention can be used with a mechanical movement or with an electronic movement; in fact it is downstream of the display parameter determination means, such as hour, quarter and minute pieces and the corresponding snails.

The invention is well suited to the production of a downstream striking module comprising, for each gong, one such actuator with its specific hammer, and the associated means for pivoting and driving the actuator. This module may be an equipped bridge. Magnetic driving offers the advantage of a compact embodiment, requiring only a ring of small thickness, which leaves more space in the watch for the gongs, and can enrich the musical spectrum offered to the user.

What is claimed is:

1. A watch comprising at least one timepiece striking mechanism, including a drive mechanism for driving and controlling the striking mechanism to operate at least one rigid hammer, movable between a first winding position and a second striking position, wherein said hammer is arranged to strike a gong in said second striking position, wherein said hammer includes at least one magnetized portion arranged to cooperate with at least one actuator capable of being driven in motion by said drive mechanism, said actuator includes at least one track with an alternating series of at least first areas and second areas with different magnetic field characteristics from each other, to whose influence said magnetized portion is successively subjected in order to trigger, as the case may be, the winding of said hammer or the striking of said hammer on said gong.

2. The watch according to claim 1, wherein said actuator is immobile when said hammer and said gong are driven in motion by said drive mechanism.

3. The watch according to claim 1, wherein, in each said track comprised in said actuator, said first areas each form a magnetic potential peak where the magnetic field has the greatest intensity in said track concerned, and each form a magnetic field barrier, of the same magnetic polarity as said magnetized portion of said hammer, and tending to prevent said magnetized portion of said hammer crossing thereover.

4. The watch according to claim 3, wherein said actuator includes at least one track with an alternating arrangement of said first areas, and of said second areas which are not magnetized, and wherein the periodic interaction between said first magnetic potential peak areas and said magnetized portion of said hammer tends to push said magnetized portion off said track, seen in plan, and/or off said actuator, seen in plan, and wherein said hammer includes elastic return means tending to return said hammer above said track and/or said actuator.

5. The watch according to claim 1, wherein said actuator includes at least a first track including an alternating arrangement of said first areas and said second areas, and a second track adjacent to said first track and which also includes an alternating arrangement of said first areas and said second areas, and wherein the magnetic field characteristics between said first areas and said second areas are different within each said track.

6. The watch according to claim 5, wherein said actuator is annular, and wherein a said first track is annular, concentric and adjacent to a said second track, which is also annular.

7. The watch according to claim 5, wherein said first areas of said first track are adjacent to the second areas of said second track, and wherein said second areas of said first track are adjacent to said first areas of said second track.

8. The watch according to claim 1, wherein, in at least one said track comprised in said actuator, said second areas each form a magnetic potential ramp where the magnetic field is of increasing or decreasing intensity, and said second areas exchange energy with said magnetized portion of said hammer during the relative displacement of said actuator with respect to said hammer.

9. The watch according to claim 8, wherein said potential ramp is an ascending ramp.

10. The watch according to claim 8, wherein said potential ramp is a descending ramp.

11. The watch according to claim 8, wherein said potential ramp is of the same magnetic polarity as said magnetized portion of said hammer.

12. The watch according to claim 8 wherein said potential ramp is of the opposite magnetic polarity to that of said magnetized portion of said hammer.

13. The watch according to claim 3, wherein said actuator is a first ring comprising an inner track and an outer track, each including an alternating arrangement of said second areas, each forming one increasing magnetic potential ramp, with increasing magnetization, and of said first areas forming potential peaks, said ramps and peaks being staggered on said inner track and said outer track and always behaving in repulsion with respect to said magnetized portion of said hammer moving above said tracks.

14. The watch according to claims 3, wherein said actuator is a second ring comprising an inner track, and an outer track, including an alternating arrangement of said second areas, each forming one increasing magnetic potential ramp, with increasing magnetization, and of said first areas forming potential peaks, said peaks being staggered on said inner track and said outer track, and said ramps and said peaks of both said tracks always behaving in repulsion with respect to said magnetized portion of said hammer moving above said tracks.

15. The watch according to claim 3, wherein said actuator is a third ring comprising an outer track including an alternating arrangement of said second areas, each forming one increasing magnetic potential ramp, with increasing magnetization, and of said first areas forming potential peaks, said ramps and said peaks of said outer track always behaving in repulsion with respect to said magnetized portion of said hammer moving above said tracks, and an inner track comprising an alternating arrangement of said second areas, each forming one potential ramp of ramps of decreasing magnetic potential, with increasing magnetization, but of opposite polarity to that of said magnetized portion of said hammer moving above said tracks, and of said first areas forming potential peaks, said peaks being staggered on both said inner track and said outer track, and said peaks of both said tracks always behaving in repulsion with respect to said magnetized portion of said hammer moving above said tracks.

16. The watch according to claim 3, wherein said actuator is a fourth ring comprising an outer track including an alternating arrangement of said second areas, each forming one increasing magnetic potential ramp, with increasing magnetization, and of said first areas forming potential peaks, said ramps and said peaks of said outer track always behaving in repulsion with respect to said magnetized portion of said hammer moving above said tracks, and an inner track comprising an alternating arrangement of said second areas, each forming one potential ramp of ramps of increasing magnetic potential, with decreasing magnetization, but of opposite polarity to that of said magnetized portion of said hammer moving above said tracks, and of said first areas forming potential peaks, said peaks being staggered on both said inner track and said outer track, and said peaks of both said tracks always behaving in repulsion with respect to said magnetized portion of said hammer moving above said tracks.

17. The watch according to claim 1, wherein said hammer includes elastic return means tending to return said hammer above said track and/or said actuator towards the hammer striking position.

18. The watch according to claim 1, wherein said drive mechanism includes at least one striking barrel wound by a timepiece movement or by a pull-piece or push-piece, and determination means for determining the sound display to perform, which are arranged to control the transmission of energy from at least one said barrel to at least one drive wheel arranged to drive at least one said actuator for the required duration and at a substantially constant speed.

19. The watch according to claim 18, wherein said determination means are arranged to control a plurality of said drive wheels, each arranged to drive at least one said actuator, in order to strike one specific said gong.

* * * * *